US009852872B2

(12) United States Patent
Higashi

(10) Patent No.: US 9,852,872 B2
(45) Date of Patent: Dec. 26, 2017

(54) MAGNETRON

(71) Applicant: Toshiba Hokuto Electronics Corporation, Asahikawa-shi, Hokkaido (JP)

(72) Inventor: Masatoshi Higashi, Hokkaido (JP)

(73) Assignee: Toshiba Hokuto Electronics Corporation, Asahikawa-shi, Hokkaido (JP)

( * ) Notice: Subject to any disclaimer, the term of this patent is extended or adjusted under 35 U.S.C. 154(b) by 0 days.

(21) Appl. No.: 15/049,925

(22) Filed: Feb. 22, 2016

(65) Prior Publication Data

US 2016/0172145 A1 Jun. 16, 2016

Related U.S. Application Data

(63) Continuation of application No. PCT/JP2014/004408, filed on Aug. 27, 2014.

(30) Foreign Application Priority Data

Aug. 29, 2013 (JP) ..... 2013-178055

(51) Int. Cl.
*H01J 23/10* (2006.01)
*H01J 25/587* (2006.01)
(Continued)

(52) U.S. Cl.
CPC ..... *H01J 25/52* (2013.01); *H01J 23/04* (2013.01); *H01J 23/10* (2013.01); *H01J 23/213* (2013.01); *H01J 23/22* (2013.01); *H01J 25/587* (2013.01)

(58) Field of Classification Search
CPC ..... H01J 25/52; H01J 25/587; H01J 23/04; H01J 23/10; H01J 23/213; H01J 23/22
See application file for complete search history.

(56) References Cited

U.S. PATENT DOCUMENTS 5,635,797 A * 6/1997 Kitakaze ..... H01J 23/05 315/39.51
2004/0012349 A1* 1/2004 Yoshihara ..... H01J 23/20 315/500

(Continued)

FOREIGN PATENT DOCUMENTS

JP 56-149750 * 11/1981 ..... H01J 23/22
JP 01-124939 * 5/1989 ..... H01J 23/20

(Continued)

OTHER PUBLICATIONS

Nov. 4, 2014—International Search Report—Intl App PCT/JP2014/004408.

*Primary Examiner* — Tung X Le
*Assistant Examiner* — Raymond R Chai
(74) *Attorney, Agent, or Firm* — Banner & Witcoff, Ltd.

(57) ABSTRACT

Provided is a low-cost magnetron that is excellent in productivity without any adverse effect on characteristics.
Two large and small strap rings 11 (11A and 11B) are only disposed at lower ends, or input sides, of a plurality of vanes 10 (10A and 10B) in the direction of a tube axis m. Diameter Rip of a protruding flat surface 41 of an input side pole piece 18 is larger than diameter Rop of a protruding flat surface 40 of an output side pole piece 17. Therefore, it is possible to provide a practical magnetron without a significant decrease in productivity or characteristics from a conventional one, while cutting costs by reducing the number of parts with the use of two strap rings on one side.

12 Claims, 14 Drawing Sheets

(51) Int. Cl.

| | |
|---|---|
| ***H01J 25/52*** | (2006.01) |
| ***H01J 23/22*** | (2006.01) |
| ***H01J 23/213*** | (2006.01) |
| ***H01J 23/04*** | (2006.01) |

(56) References Cited

U.S. PATENT DOCUMENTS

| | | | | |
|---|---|---|---|---|
| 2007/0296515 | A1* | 12/2007 | Kato | H01J 23/10 332/132 |
| 2009/0066252 | A1* | 3/2009 | Higashi | H01J 25/50 315/39.51 |
| 2011/0234093 | A1* | 9/2011 | Higashi | H01J 25/587 315/39.51 |

FOREIGN PATENT DOCUMENTS

| | | | | | |
|---|---|---|---|---|---|
| JP | H04-014734 | A | | 1/1992 | |
| JP | H09-129149 | A | | 5/1997 | |
| JP | H11-024939 | A | | 1/1999 | |
| JP | 2009-070613 | | | 4/2009 | |
| JP | EP 2237304 | A2 | * | 10/2010 | H01J 23/10 |
| JP | 2013-073730 | | * | 4/2013 | H01J 23/20 |
| JP | 2013-073730 | A | | 4/2013 | |

* cited by examiner

| Diameter of protruding flat surface | | Efficiency(%) |
|---|---|---|
| Rip | Rop | |
| 12.0 | 12.0 | 72.2 |
| | 16.0 | 70.9 |
| | 18.0 | 70.1 |
| 16.0 | 12.0 | 71.6 |
| | 16.0 | 70.5 |
| | 18.0 | 69.7 |
| 18.0 | 12.0 | 71.3 |
| | 16.0 | 70.3 |
| | 18.0 | 69.5 |

| Rip | Higher harmonic wave | | | | | |
|---|---|---|---|---|---|---|
| | Second | Third | Fourth | Fifth | Sixth | Seventh |
| 12.0 | -14.1 | -19.0 | -26.4 | -27.8 | -39.8 | -36.2 |
| 16.0 | -13.4 | -18.6 | -28.7 | -27.5 | -40.6 | -35.4 |
| 18.0 | -13.1 | -19.5 | -32.6 | -31.3 | -44.9 | -34.3 |

| Ra | $\eta$ |
|---|---|
| 8.5 | 69.6721 |
| 8.6 | 70.0379 |
| 8.7 | 70.3844 |
| 8.8 | 70.7246 |
| 8.9 | 71.0473 |
| 9 | 71.3574 |

| Ra | ibm |
|---|---|
| 8.5 | 1.74216 |
| 8.6 | 1.66881 |
| 8.7 | 1.6 |
| 8.8 | 1.53536 |
| 8.9 | 1.47456 |

| Rpp | ibm |
|---|---|
| 12 | 2.08 |
| 14 | 2 |
| 16 | 1.8 |
| 18 | 1.6 |
| 20 | 1.4 |

| Rpp/Ra | Bg |
|---|---|
| 0.8 | 84 |
| 0.9 | 86 |
| 1 | 88 |
| 1.1 | 90 |
| 1.2 | 92 |
| 1.3 | 92.8 |
| 1.4 | 93 |

| Rpp/Ra | Bg |
|---|---|
| 0.8 | 200.6 |
| 0.9 | 201.3 |
| 1 | 201.5 |
| 1.1 | 201 |
| 1.2 | 199.5 |
| 1.3 | 197 |
| 1.4 | 195 |

- Prior Art -

(A)

(B)

- Prior Art -

MAGNETRON

CROSS REFERENCE TO RELATED APPLICATIONS

This is a U.S. Bypass Continuation Application of International Application No. PCT/JP2014/004408, filed Aug. 27, 2014, which claims priority to Japanese Patent Application No. 2013-178055 filed Aug. 29, 2013 the entire contents of which are incorporated herein by reference.

TECHNICAL FIELD

The present invention relates to a magnetron, and is suitably applied to a continuous wave magnetron used in microwave heating equipment such as microwave ovens.

BACKGROUND ART

As shown in FIG. 14, a conventional anode structure 100 of a typical magnetron, such as those for microwave ovens, which oscillates to generate 2,450 MHz-band microwaves, includes an anode cylinder 101; and vanes 102, which are radially disposed inside the anode cylinder 101.

The vanes 102 are connected together through a pair of large and small strap rings 103, which each are brazed to both upper and lower ends of every other vane 102 in the circumferential direction.

In an electron interaction space surrounded by free ends of a plurality of vanes 102, a spiral cathode 104 is disposed along an axis of the anode cylinder 101. Both ends of the cathode 104 are fixed to an output side end hat 105 and an input side end hat 106.

To both ends of the anode cylinder 101, pole pieces 107 and 108, which are almost funnel-shaped, are fixed.

The strap rings 103 are designed to alternately keep the vanes 102 at the same potential. As described above, the structure in which a pair of large and small strap rings 103 are provided at both upper and lower ends of the vanes 102 is currently popular. There are other structures, such as a structure in which the upper and lower ends are each provided with one strap ring, or a structure in which one of the upper and lower ends is provided with two or more strap rings, or a structure in which two strap rings are provided in an up-down direction central portion of vanes.

PRIOR ART DOCUMENTS

Patent Documents

[Patent Document 1] Japanese Patent Application Laid-open Publication No. 2013-73730

[Patent Document 2] Japanese Patent Application Laid-open Publication No. H07-302548

SUMMARY OF THE INVENTION

Problems to be Solved by the Invention

A cavity resonator with the above-described configuration, which is separated by vanes 102 of the magnetron, has a specific frequency. However, in the case of the typical strap ring type, the frequency is significantly affected by the capacitance between vanes and strap rings and the capacitance between the strap rings.

For example, for the sake of an improvement in productivity or a reduction in costs, strap rings may not be provided on both upper and lower ends of a vane, and instead two strap rings may be provided on only one end. In such a case, the capacitance of the cavity resonator becomes smaller than cases where the upper and lower ends are each provided with two strap rings.

As a result, in some cases, the frequency of the cavity resonator becomes several hundreds of MHz higher than cases where the upper and lower ends are each provided with two strap rings. It is necessary to regulate the frequency.

In this case, for example, possible measures to be taken include: narrowing the distance between the strap rings and the vanes; and increasing the cross-section of the strap rings.

However, if such measures are taken, a short circuit may occur during the brazing between the strap rings, or between the strap rings and the vanes, due to brazing material, or the volume of the strap rings would increase. This leads to a reduction in productivity or an increase in costs.

If only one end of the vane is provided with strap rings, an imbalance in electric field distribution between the upper and lower ends of the vane becomes larger than the structure in which strap rings are vertically symmetrically disposed at the upper and lower ends. This leads to a decrease in load stability, electronic reverse shock, and efficiency, or is prone to undesired noise.

In particular, the load stability and the reverse impact by electrons may be a major problem when the magnetron is used in microwave heating equipment such as microwave ovens where reflected waves come back. Accordingly, the structure in which only one end of the vane is provided with strap rings has not been put into practical use so far for the magnetrons of microwave ovens. The structure is therefore not being used except for a pulse magnetron or the like that is substantially free of such worries.

Incidentally, to improve the stability of oscillation, another proposal is to provide one end of the vane with three or more strap rings. According to this configuration, the cross section of the strap rings is relatively small compared with the structure in which one end is provided with two strap rings, and the stability of oscillation increases. However, in the case of this configuration, the diameter of an outermost strap ring is greater than that of the structure in which two strap rings are provided. If the strap rings are punched from plate-like material, an even larger material is required, and an amount of scraps would increase, resulting in a decrease in material efficiency and diminishing the effects of cost reduction.

Regardless of how many strap rings are provided, making adjustments to the frequency would be difficult particularly when only the output side is provided with strap rings. Usually, in consideration of variations associated with the accuracy of components and assembling, the resonance frequency of the anode structure is designed in such a way as to be slightly higher than a predetermined frequency, and the frequency is adjusted after the assembling.

In this case, for example, various adjustment methods may be available, such as partially removing the vanes or deforming the strap rings. However, in terms of productivity, side effects on characteristics, and easiness of the adjustments, what is frequently used is a method of adjusting the frequency to a desired frequency by inserting an antenna coming from an anode structure assembly into a waveguide of the measurement use, deforming an input side strap ring in an axis direction while monitoring the resonance frequency, and thereby narrowing the distance between the strap ring and a vain and increasing the capacitance.

However, according to this adjustment method, the strap ring needs to be provided at the input side. If strap rings are provided only at the output side, this adjustment method cannot be used. Moreover, if the cross section of the strap ring is large, it is difficult to deform the strap ring itself, and the adjustment method cannot be used.

If the upper and lower ends of a vane are each provided with one strap ring, then the capacitance between the strap rings comes to zero. Therefore, the cross section (volume) of the strap ring needs to be significantly larger compared with cases where each is provided with two strap rings. As a result, it is difficult to deform the strap ring itself, and the above-described adjustment method cannot be used.

Furthermore, it is known that the structure in which strap rings are provided in the central portion of the vane is highly unfavorable in terms of productivity.

The present invention has been made to solve the above problems. The object of the present invention is to provide a magnetron that is low in costs and excellent in productivity without any adverse effects on the characteristics.

Means for Solving the Problems

To achieve the above object, a magnetron of the present invention is characterized by including: an anode cylinder that cylindrically extends along a tube axis; a plurality of vanes that extend from an inner surface of the anode cylinder toward the tube axis in such a way that free ends form a vane inscribed circle; two large and small strap rings that are different in diameter and which alternately short-circuit the plurality of vanes; a cathode that is disposed along the tube axis in the vane inscribed circle formed by the free ends of the plurality of vanes; pole pieces that are disposed at both ends of the anode cylinder in a tube axis direction and which lead magnetic flux into an interaction space between the free ends of the plurality of vanes and the cathode; and an antenna that is pulled out from at least one of the vanes, wherein the strap rings are only disposed on a cathode input side one of two ends of the vane in the tube axis direction, the shape of the pole piece that is disposed at one end of the anode cylinder in the tube axis direction and the shape of the pole piece that is disposed at the other end are asymmetrical, and the pole pieces that are disposed at both ends of the anode cylinder in the tube axis direction include protruding flat surfaces, and a diameter of the protruding flat surface of the pole piece that is disposed at one end or input side is larger than a diameter of the protruding flat surface of the pole piece that is disposed at the other end or output side.

Advantages of the Invention

According to the present invention, it is possible to provide a practical magnetron without a significant decrease in productivity or characteristics from a conventional one, while cutting costs by reducing the number of parts with the use of two strap rings on one side.

EMBODIMENTS FOR CARRYING OUT THE INVENTION

One embodiment of a magnetron of the present invention will be described with reference to the accompanying drawings. Incidentally, embodiments described below are given for illustrative purposes only, and the present invention is not limited to these embodiments.

Figure 1:
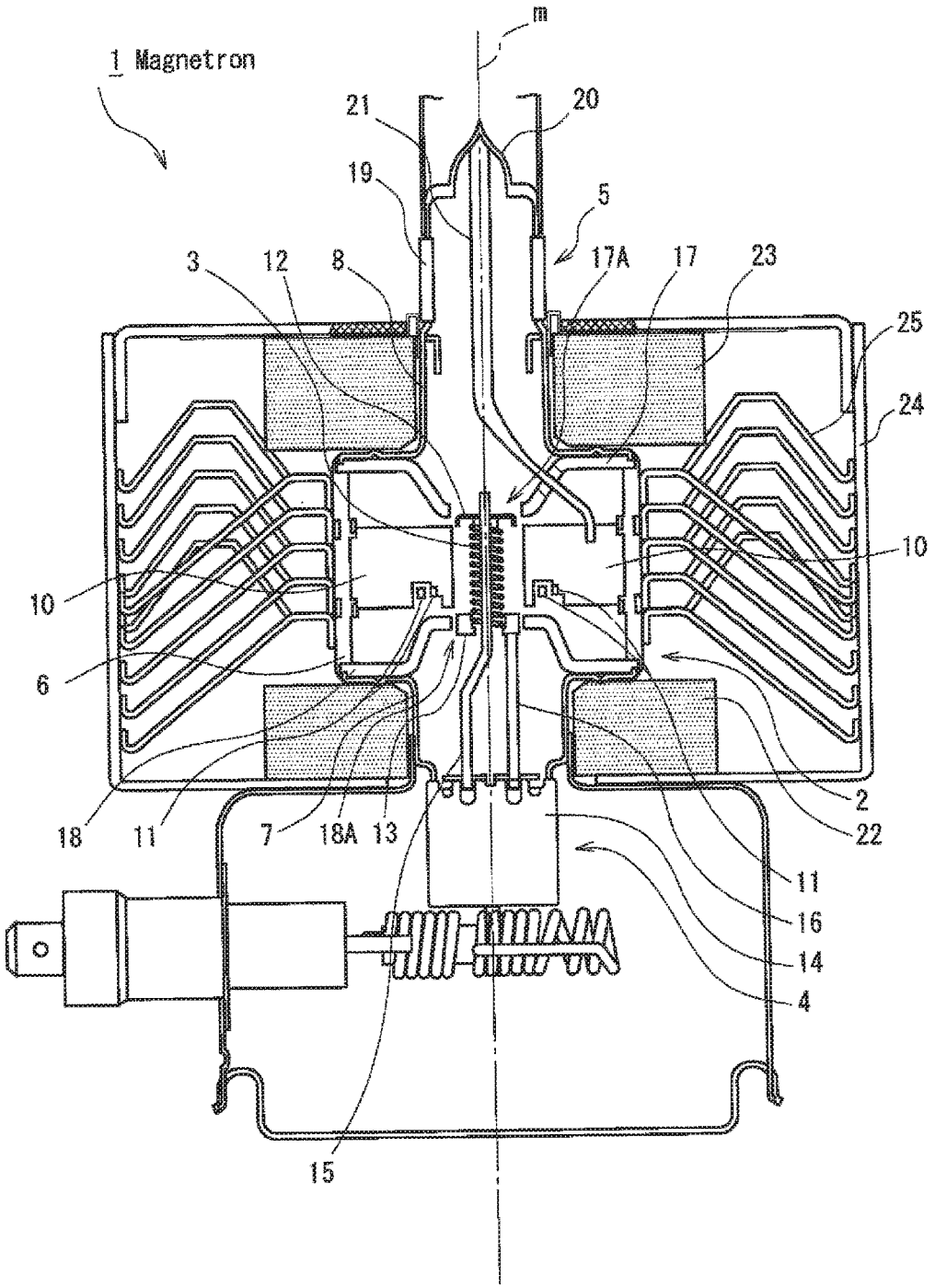
FIG. 1 is a longitudinal cross-sectional view of an entire magnetron according to one embodiment of the present invention.

FIG. 1 is a longitudinal cross-sectional view schematically showing a magnetron 1 according to the present embodiment. The magnetron 1 is a magnetron for microwave ovens that generate a 2,450 MHz-band fundamental wave.

The magnetron 1 includes, as a main component, an anode structure 2 that generates a 2, 450 MHz-band fundamental wave. Below the anode structure 2, an input unit 4, which supplies power to a cathode 3 located at the center of the anode structure 2, is disposed. Above the anode structure 2, an output unit 5, which leads microwaves generated from the anode structure 2 out of a tube (or magnetron 1), is disposed.

The input unit 4 and the output unit 5 are joined to an anode cylinder 6 of the anode structure 2 in a vacuum-tight manner by an input side metal sealing member 7 and an output side metal sealing member 8.

The anode structure 2 includes the anode cylinder 6, a plurality of vanes 10 (e.g. 10 vanes), and two large and small strap rings 11.

The anode cylinder 6 is made of copper, for example, and is formed into a cylindrical shape. The anode cylinder 6 is disposed in such a way that the central axis thereof passes through a tube axis m, or the central axis of the magnetron 1.

Each of the vanes 10 is made of copper, for example, and is formed into a plate shape. Inside the anode cylinder 6, the vanes 10 are radially disposed around the tube axis m. An outer end of each vane 10 is joined to an inner peripheral surface of the anode cylinder 6; an inner end of each vane 10 is a free end. A cylindrical space surrounded by the free ends of the plurality of vanes 10 serves as an electron interaction space.

Among both upper and lower ends in the direction of the tube axis m of the plurality of vanes 10, the two large and small strap rings 11 are fixed to the lower end positioned at an input side.

In the electron interaction space surrounded by the free ends of the plurality of vanes 10, the spiral cathode 3 is provided along the tube axis m. The cathode 3 is disposed away from the free ends of the plurality of vanes 10. The anode structure 2 and the cathode 3 work as a resonance portion of the magnetron 1.

On an upper and a lower end of the cathode 3, end hats 12 and 13 are fixed in order to prevent electrons from leakage. The end hat 12 located at upper end positioned at an output side is formed into a disc shape. The end hat 13 located at the input side lower end is formed into a ring shape.

The input unit 4 located below the anode cylinder 6 includes a ceramic stem 14; a center support rod 15 and a side support rod 16 planted in the ceramic stem.

The center support rod 15 passes through a central hole of the input side end hat 13 of the cathode 3 and then through the center of the cathode 3 in the direction of the tube axis m, and is joined to the output side end hat 12 of the cathode 3. The center support rod 15 is electrically connected to the cathode 3 via the end hat 12.

The side support rod 16 is joined to the input side end hat 13 of the cathode 3. The side support rod 16 is electrically connected to the cathode 3 via the end hat 13. The center support rod 15 and the side support rod 16 are designed to support the cathode 3 and supply current to the cathode 3.

On an inner side of the upper end (output side end) of the anode cylinder 6 and on an inner side of the lower end (input side end), a pair of pole pieces 17 and 18 are provided in such a way that the space between the end hats 12 and 13 is sandwiched and that the pole pieces 17 and 18 face each other.

A central portion of the output side pole piece 17 has a through-hole 17A whose diameter is slightly larger than the output side end hat 12. The output side pole piece 17 is substantially formed into a shape of funnel that spreads around the through-hole 17A toward the output side (upper side). The output side pole piece 17 is disposed in such a way that the tube axis m passes through the center of the through-hole 17A.

A central portion of the input side pole piece 18 has a through-hole 18A whose diameter is slightly larger than the input side end hat 13. The input side pole piece 18 is substantially formed into a shape of funnel that spreads around the through-hole 18A toward the input side (lower side). The input side pole piece 18 is disposed in such a way that the tube axis m passes through the center of the through-hole 18A.

To the upper end of the output side pole piece 17, a lower end of the substantially cylindrical metal sealing member 8, which extends in the direction of the tube axis m, is fixed. The metal sealing member 8 is also in contact with the upper end of the anode cylinder 6. To the lower end of the input side pole piece 18, an upper end of the substantially cylindrical metal sealing member 7, which extends in the direction of the tube axis m, is fixed. The metal sealing member 7 is also in contact with the lower end of the anode cylinder 6.

To the upper end of the output side metal sealing member 8, an insulating cylinder 19, which is part of the output unit 5, is joined. To an upper end of the insulating cylinder 19, an exhaust tube 20 is joined.

An antenna 21 that is lead out from one of the plurality of vanes 10 passes through the output side pole piece 17 and extends inside the metal sealing member 8 toward the upper end thereof; the tip of the antenna 21 is held by the exhaust tube 20 and thereby fixed.

To the lower end of the input side metal sealing member 7, the ceramic stem 14, which is part of the input unit 4, is joined. That is, the center support rod 15 and side support rod 16, which are planted in the ceramic stem 14, go inside the metal sealing member 7 to be connected to the cathode 3.

Outside the metal sealing members 7 and 8, a pair of ring-shaped magnets 22 and 23 are provided in such a way that the anode cylinder 6 is sandwiched in the direction of the tube axis m and that the magnets 22 and 23 face each other. The pair of magnets 22 and 23 generate a magnetic field in the direction of the tube axis m.

The anode cylinder 6 and the magnets 22 and 23 are covered with a yoke 24; the pair of magnets 22 and 23 and the yoke 24 constitute a magnetic circuit. A magnetic flux coming from the magnets 22 and 23 of the magnetic circuit is led by the pair of pole pieces 17 and 18 to the electron interaction space between the free ends of the vanes 10 and the cathode 3.

Between the anode cylinder 6 and the yoke 24, a radiator 25 is provided. The radiator 25 releases the heat generated by the oscillation of the anode structure 2 out of the magnetron 1.

The configuration of the magnetron 1 has been outlined above.

Figure 2:
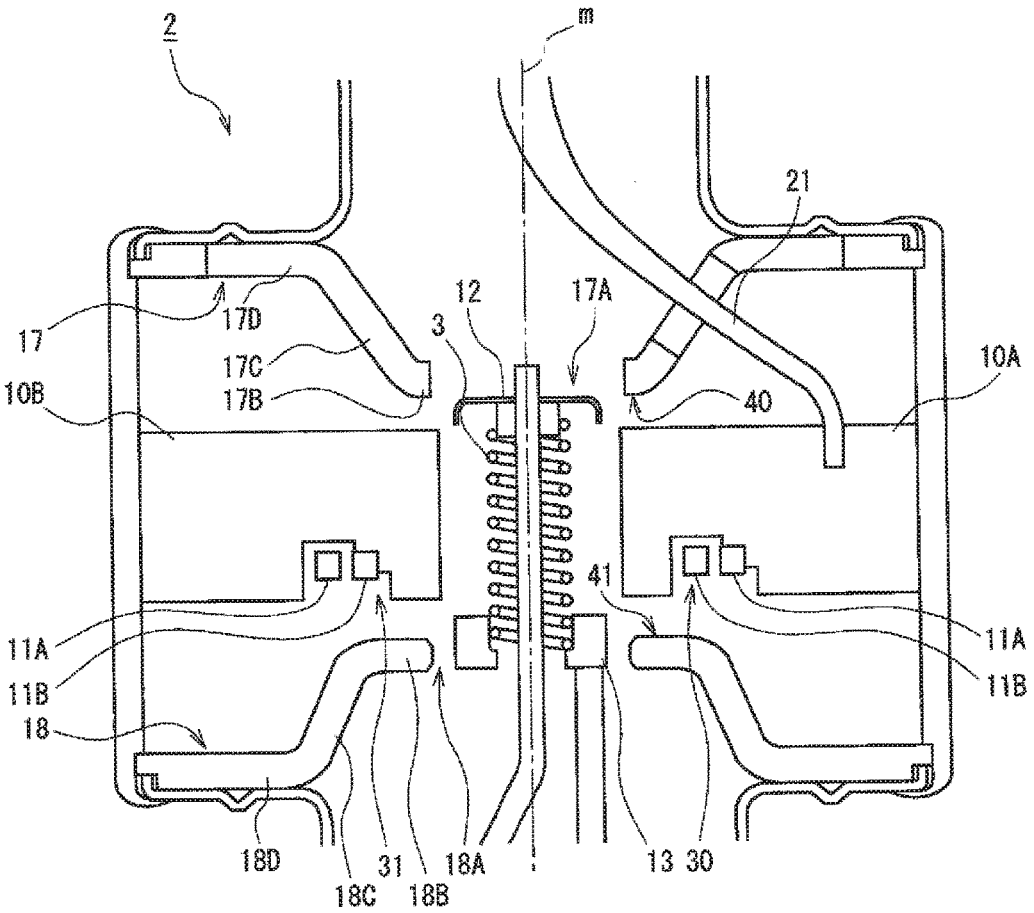
FIG. 2 is a longitudinal cross-sectional view of major portions of a magnetron according to one embodiment of the present invention.
Figure 3:
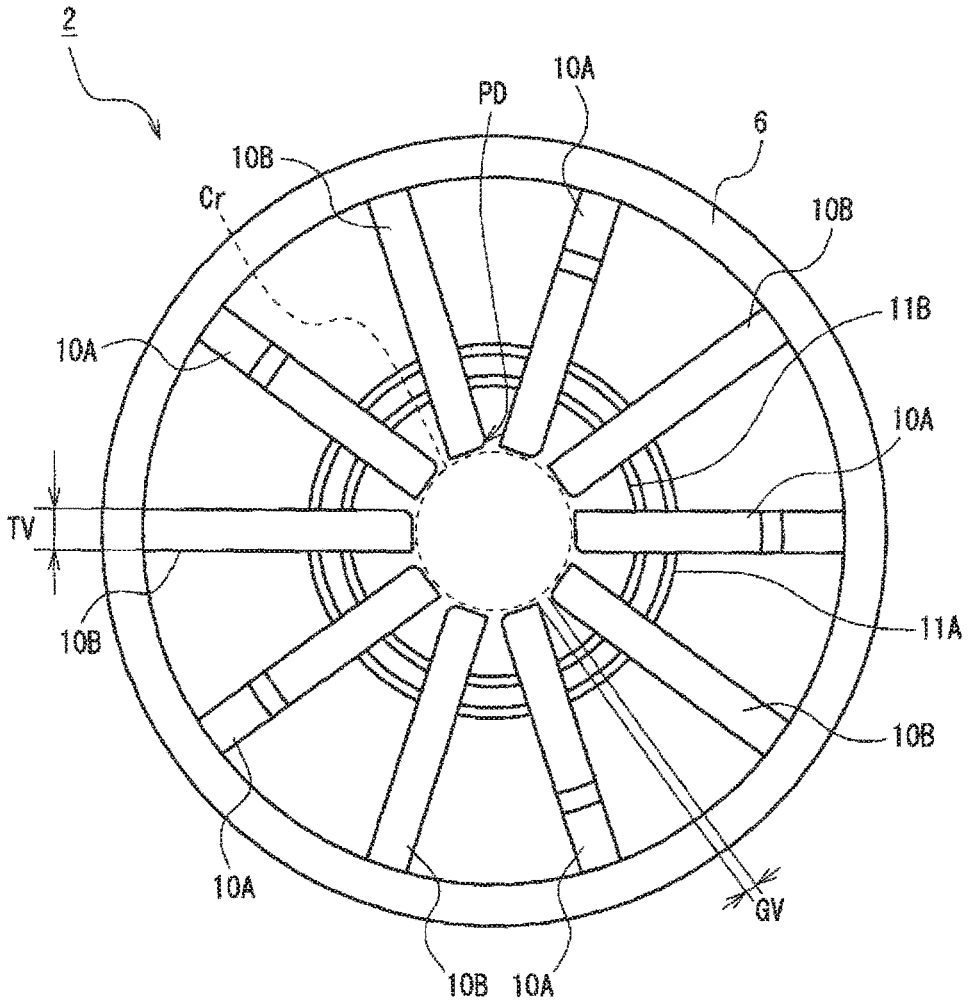
FIG. 3 is a lateral cross-sectional view of major portions of a magnetron according to one embodiment of the present invention.
Figure 4:
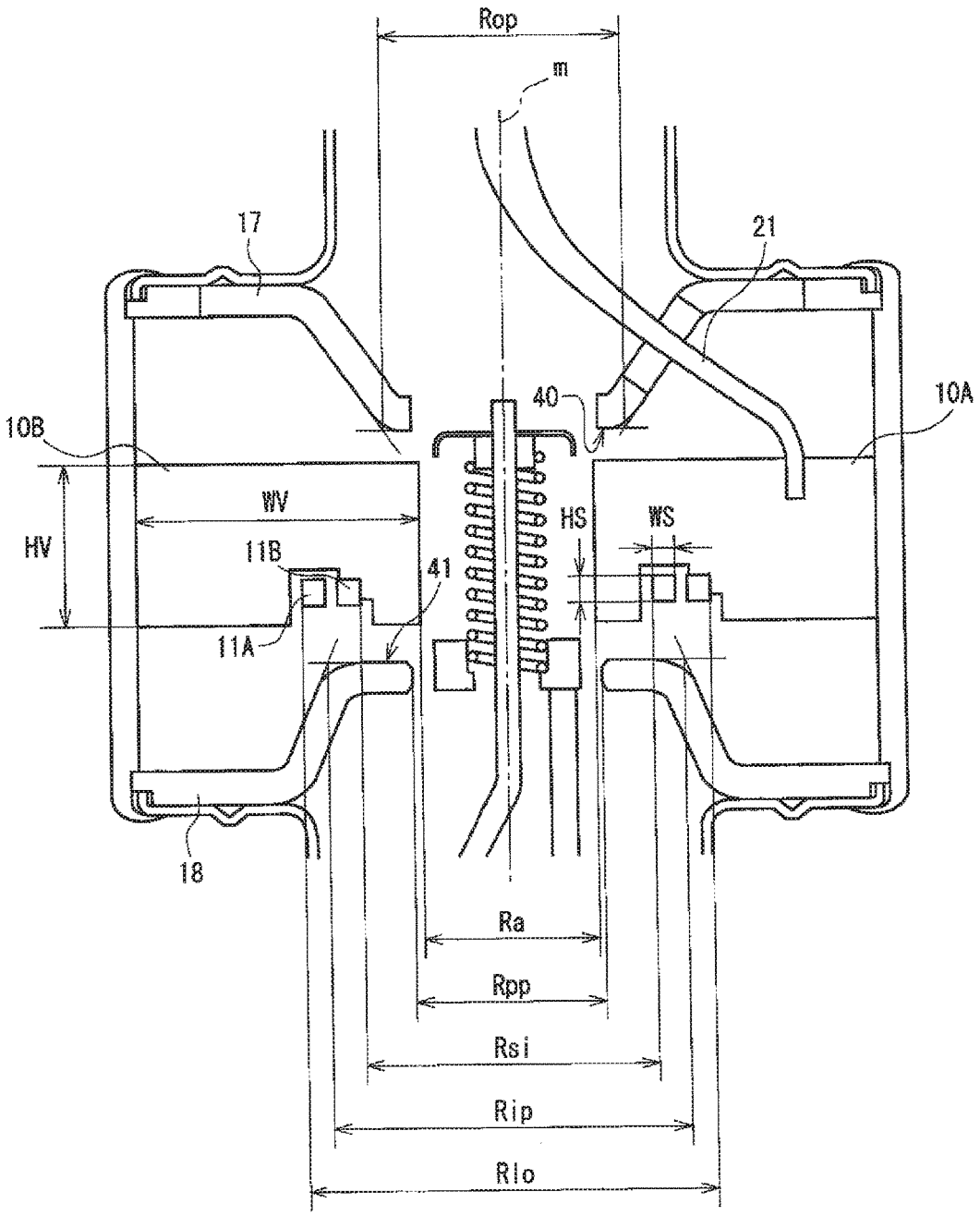
FIG. 4 is a longitudinal cross-sectional view showing dimensions of major portions of a magnetron according to one embodiment of the present invention.

With the use of FIGS. 2 to 4, the configuration of the vanes 10, strap rings 11, and pole pieces 17 and 18 will be described in more detail. FIG. 2 is a longitudinal cross-sectional view of the anode structure 2 and FIG. 3 is a lateral schematic view of the anode structure 2 when seeing from the output unit's side. Incidentally, in FIG. 3, in order to make the configuration of the vanes 10 and strap rings 11 to explain easily, portions other than the anode cylinder 6, vanes 10, and strap rings 11 are omitted. FIG. 4 is a longitudinal cross-sectional view showing dimensions of each portion of the anode structure 2.

As described above, inside the anode cylinder 6 of the anode structure 2, the plurality of vanes 10 are radially disposed around the tube axis m. To the input side ends of the plurality of vanes 10, two large and small strap rings 11 are fixed.

Incidentally, among the two large and small strap rings 11, the strap ring 11 that is larger in diameter is referred to as a large-diameter strap ring 11A, and the strap ring 11 that is smaller in diameter is referred to as a small-diameter strap ring 11B.

According to the present embodiment, inside the anode cylinder 6, ten vanes 10 are disposed. The ten vanes 10 consist of five vanes 10A and five vanes 10B. Inside the anode cylinder 6, the vanes 10A and the vanes 10B are alternately disposed in such a way that the vanes 10A are adjacent to the vanes 10B. Incidentally, as shown in FIG. 3, a circle Cr that is inscribed to the free ends of the vanes 10A and 10B will be referred to as a vane inscribed circle Cr.

In the input side ends (lower ends) of the vanes 10A, there are respectively a stepped notch 30 formed to be deeper than the thickness of the large-diameter strap ring 11A and small-diameter strap ring 11B. In the input side ends (lower ends) of the vanes 10B, there are respectively a stepped notch 31 formed to be deeper than the thickness of the large-diameter strap ring 11A and small-diameter strap ring 11B.

The large-diameter strap ring 11A is inserted into the inner portions of the notches 30 of the vanes 10A and the inner portions of the notches 31 of the vanes 10B. In this manner, the large-diameter strap ring 11A is embedded in the lower ends of the vanes 10A and 10B close to the center of the tube axis m.

Incidentally, the large-diameter strap ring 11A is joined by brazing to inner edges of the notches 30 of the vanes 10A while not being in contact with the notches 31 of the vanes 10B.

That is, the large-diameter strap ring 11A is joined only to the vanes 10A, thereby connecting the five vanes 10A together. To the output side end (upper end) of one of the vanes 10A that are joined to the large-diameter strap ring 11A, the antenna 21 is connected.

The small-diameter strap ring 11B is inserted into the inner portions of the notches 30 of the vanes 10A and the inner portions of the notches 31 of the vanes 10B. In this manner, the small-diameter strap ring 11B is embedded in the lower ends of the vanes 10A and 10B close to the center of the tube axis m.

Incidentally, the small-diameter strap ring 11B is joined by brazing to inner edges of the notches 31 of the vanes 10B while not being in contact with the notches 30 of the vanes 10A.

That is, the small-diameter strap ring 11B is joined only to the vanes 10B, thereby connecting the five vanes 10B together.

Inside the anode cylinder 6, the cathode 3 is provided in the electron interaction space surrounded by the free ends of the vanes 10A and vanes 10B. To the upper and lower ends of the cathode 3, the end hats 12 and 13 are respectively fixed.

Inside the anode cylinder 6, there are provided a pair of pole pieces 17 and 18 facing each other which sandwich the space between the end hats 12 and 13.

Both the output side pole piece 17 and the input side pole piece 18 are substantially funnel-shaped as a whole. However, the output side pole piece 17 and the input side pole piece 18 are partially different in shape.

The output side pole piece 17 includes a lower end portion 17B, which is at right angles to the tube axis m and at the center of which the through-hole 17A is formed; an intermediate portion 17C, which is located outside the lower end portion 17B and conically extends from the outer edge of the lower end portion 17B toward the output side (upper side); and an upper end portion 17D, which is located outside the intermediate portion 17C and parallel to the lower end portion 17B. The output side pole piece 17 is substantially funnel-shaped as a whole.

In that manner, the output side pole piece 17 is shaped in such a way that the center portion (lower end portion 17B) protrudes toward the lower side (or the input side). A flat surface 40 of a lower end of the lower end portion 17B will be referred to as a protruding flat surface 40.

The input side pole piece 18 includes an upper end portion 18B, which is at right angles to the tube axis m and at the center of which the through-hole 18A is formed; an intermediate portion 18C, which is located outside the upper end portion 18B and conically extends from the outer edge of the upper end portion 18B toward the input side (lower side); and a lower end portion 18D, which is located outside the intermediate portion 18C and parallel to the upper end portion 18B. The input side pole piece 18 is substantially funnel-shaped as a whole.

In that manner, the input side pole piece 18 is shaped in such a way that the center portion (upper end portion 18B) protrudes toward the upper side (or the output side). A flat surface 41 of an upper end of the upper end portion 18B will be referred to as a protruding flat surface 41.

The protruding flat surfaces 40 and 41 of the output side pole piece 17 and input side pole piece 18 are different in diameter each other.

Incidentally, in this case, as shown in FIG. 4, the diameter of the protruding flat surface 40 of the output side pole piece 17 is defined as a diameter of a circumference containing an intersection point where an extension of the protruding flat surface 40 crosses an extension of a tapered surface of the intermediate portion 17C. The diameter of the protruding flat surface 41 of the input side pole piece 18 is defined as a diameter of a circumference containing an intersection point where an extension of the protruding flat surface 41 crosses an extension of a tapered surface of the intermediate portion 18C.

The dimensions of major portions will be described below. The outer diameter Rlo of the large-diameter strap ring 11A is 20.3 mmϕ; the inner diameter thereof is 18.05 mmϕ; the thickness thereof is 1.3 mm.

The outer diameter of the small-diameter strap ring 11B is 16.75 mmϕ; the inner diameter Rsi thereof is 14.5 mmϕ and the thickness thereof is 1.3 mm.

The diameter Rop of the protruding flat surface 40 of the output side pole piece 17 is 12 mmϕ. The diameter Rip of the protruding flat surface 41 of the input side pole piece 18 is 18 mmϕ.

The dimensions are set in such a way as to satisfy the following formula (1).

$$Rop<(Rsi+Rlo)/2\leq Rip \quad (1)$$

Actually, in the case of the present embodiment, (Rsi+Rlo)/2 is 17.4; the diameter Rop of the protruding flat surface 40 of the output side pole piece 17 is 12; and the diameter Rip of the protruding flat surface 41 of the input side pole piece 18 is 18. Therefore, the above formula (1) is satisfied.

The dimensions of other parts will be described below. The inner diameter of the anode cylinder 6 is 36.7 mmϕ. The vanes 10A and 10B are 1.85 mm in thickness, and 8.0 mm in height in the direction of the tube axis m. The vane inscribed circle Cr is 8.7 mmϕ in diameter. The outer diameter of the cathode 3 is 3.9 mmϕ.

The outer diameter of the end hats 12 and 13 is 7.2 mmϕ. The inner diameter of the output side pole piece 17, i.e. the diameter of the through-hole 17A is 9.2 mmϕ; the inner diameter of the input side pole piece 18, i.e. the diameter of the through-hole 18A is 9.4 mmϕ.

As described above, according to the present embodiment, the two large and small strap rings 11 (11A and 11B) are disposed only at the lower end sides, i.e. the input sides in the direction of the tube axis m of the plurality of vanes 10 (10A and 10B). Moreover, the diameter Rip of the protruding flat surface 41 of the input side pole piece 18 is larger than the diameter Rop of the protruding flat surface 40 of the output side pole piece 17.

Then, the diameter Rop of the protruding flat surface 40 of the output side pole piece 17, the diameter Rip of the protruding flat surface 41 of the input side pole piece 18, the outer diameter Rlo of the large-diameter strap ring 11A, and the inner diameter Rsi of the small-diameter strap ring 11B are set in such a way as to satisfy the above formula (1).

Although the details will be given later, this magnetron 1 is more practical than the conventional one without a significant decrease in productivity or characteristics, while achieving a reduction in costs by reducing the number of parts, i.e. the number of strap rings 11 (11A and 11B), only two of which are provided on one side.

In order to prove that the above-mentioned advantageous effects can be actually achieved, several verification experiments are carried out. The results will be described below.

Figure 5:
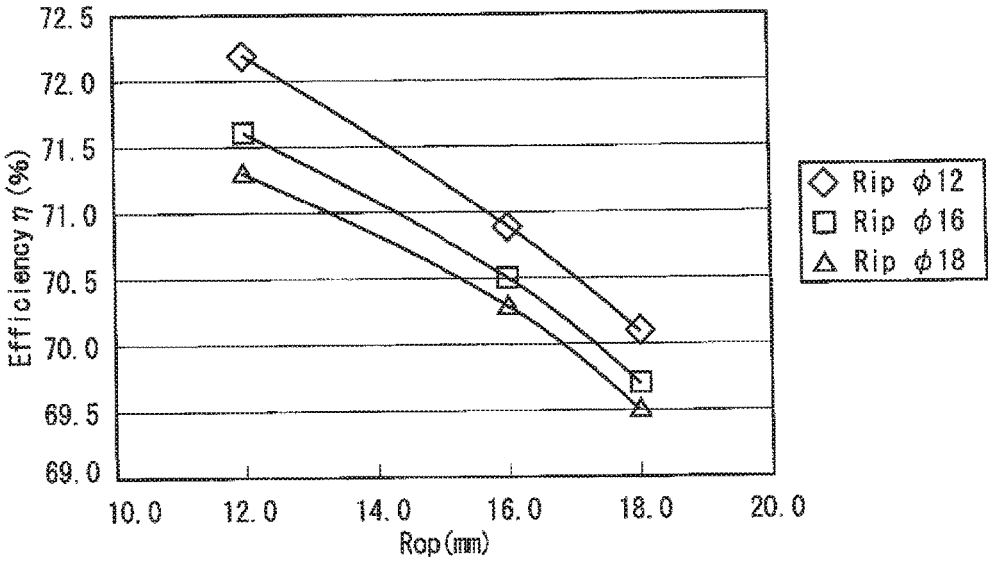
FIG. 5 is a diagram and table showing relation between dimensions of a pole piece and efficiency illustrating a magnetron according to one embodiment of the present invention.
Figure 6:
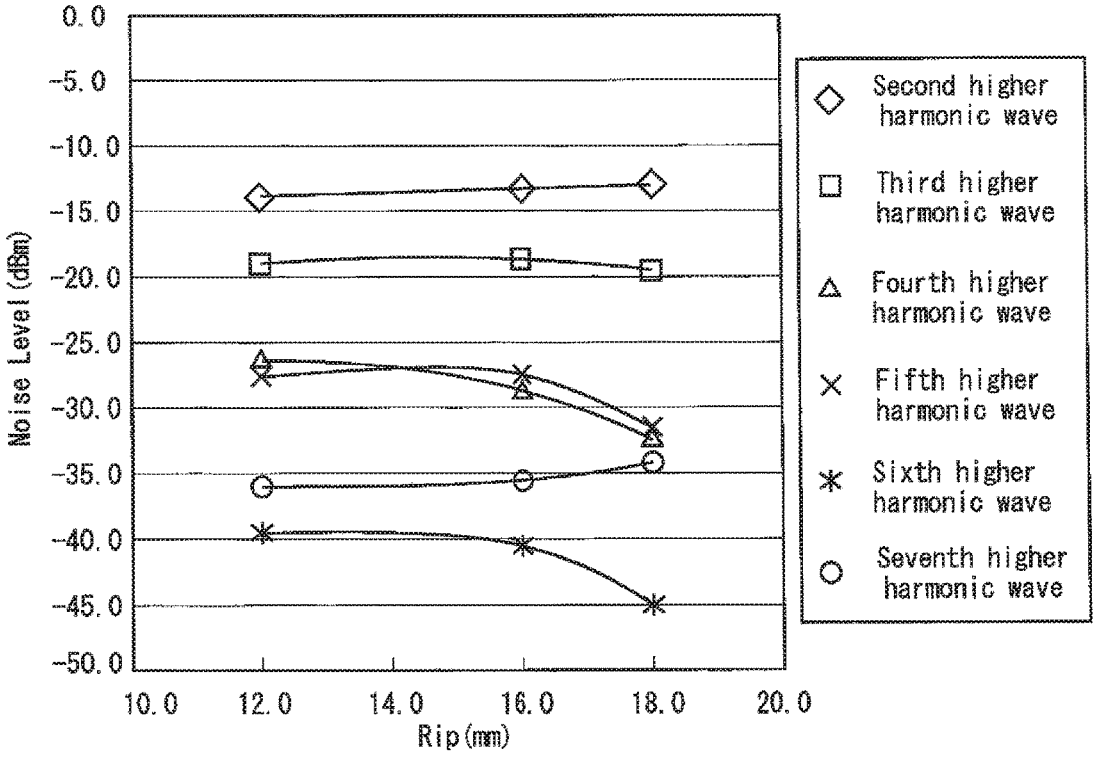
FIG. 6 is a diagram and table showing relation between dimensions of a pole piece and higher harmonic waves illustrating a magnetron according to one embodiment of the present invention.

In order to compare with the magnetron 1 of the present embodiment, prototype tubes were made in such a way as to have different dimensions of the output side pole piece and input side pole piece. FIGS. 5 and 6 show the results of verifying these prototype tubes, with a focus on efficiency and higher harmonic waves, which would become unnecessary radiation.

As shown in FIG. 5, in all of both the output side pole piece and the input side pole piece, lowering of output efficiency occurs, so that the diameters Rop and Rip of the protruding flat surfaces become larger. Particularly diameter Rop of the protruding flat surface of the output side pole piece has a greater influence on the efficiency.

Furthermore, based on the results of verification, in order to secure the same level of efficiency (70%) as the conventional magnetron in which a pair of large and small strap rings is provided at both upper and lower ends of the vane, the diameter Rop of the protruding flat surface of the output side pole piece is preferred to be at between about 12 mmϕ and 14 mmϕ. In such a case, the allowable range of the diameter Rip of the protruding flat surface of the input side pole piece is expected to be up to 20 mmϕ.

As for higher harmonic waves, as shown in FIG. 6, when the diameter Rip of the protruding flat surface of the input side pole piece is 18 mmϕ, the levels of the second and seventh higher harmonic waves become slightly higher. However, the levels of the fourth, fifth, and sixth higher harmonic waves decrease.

Incidentally, the data shown in FIG. 6 are the results of verification on prototype tubes in which, in view of the efficiency, the diameter Rop of the protruding flat surface of the output side pole piece was fixed at 12 mmϕ, and the configuration of components remained unchanged except for that of the input side pole piece, and only the diameter Rip of the protruding flat surface of the input side pole piece was changed.

It is clear from the above verification results that the magnetron 1 of the present embodiment has well-balanced excellent characteristics by achieving 70% or more of efficiency and curbing unnecessary radiation, because the diameter Rop of the protruding flat surface 40 of the output side pole piece 17 is 12 mmϕ and the diameter Rip of the protruding flat surface 41 of the input side pole piece 18 is 18 mmϕ.

In the case of the magnetron 1 of the present embodiment, the load stability is 1.6 A, and the reverse impact by electrons is 88%. In the case of the conventional magnetron in which a pair of large and small strap rings is provided at both upper and lower ends of the vane, the load stability is 1.8 A, and the reverse impact by electrons is 90%.

In that manner, the load stability and the reverse impact by electrons of the magnetron 1 of the present embodiment are lower than those of the conventional magnetron. However, the load stability and the reverse impact by electrons of the magnetron 1 of the present embodiment are within a range where no practical problems occur. The reason is considered to be that the output side pole piece 17 and the input side pole piece 18 have the above-described shapes and dimensions, and that the large-diameter strap ring 11A and the small-diameter strap ring 11B are embedded in the lower end portions of the vanes 10A and 10B.

As for the reverse impact by electrons, the antenna 21 connected to a vane 10B that is joined to the small-diameter strap ring 11B is known to achieve better results than the antenna 21 connected to a vane 10A that is joined to the large-diameter strap ring 11A as in the case of the magnetron 1.

However, such antenna 21 being connected to the vane 10B comes with a side effect, the level of the third higher harmonic wave becomes significantly higher. Therefore, the antenna 21 being connected to the vane 10B is not appropriate for the magnetron 1.

Furthermore, in general, it is known that the vanes that are higher in the direction of the tube axis work better in terms of the load stability and efficiency and the like. However, in the case of the magnetron 1, if the height of the vanes 10A and 10B in the direction of the tube axis m is greater than 8.0 mm, a difference in electric field distribution between upper and lower portions of the anode structure 2 becomes larger. This configuration is therefore likely to cause a worsening of characteristics such as higher harmonic waves and runs counter to efforts to reduce the costs.

In terms of the load stability and output and the like, it is difficult to set the height of the vanes 10A and 10B in the direction of the tube axis mat less than 8.0 mm. Accordingly, given manufacturing tolerances and the like, it is preferred that the height of the vanes 10A and 10B in the direction of the tube axis m should practically be between 7.8 mm and 8.2 mm.

Moreover, a significant increase in the cross section of the strap rings 11 (11A and 11B) and in the thickness of the vanes 10 (10A and 10B) from the conventional dimensions is not a practical option in terms of costs and productivity. There is also a limit on attempts to significantly reduce the dimensions, because problems could arise in terms of durability and heat resistance.

Therefore, if the height of the strap rings 11 in the direction of the tube axis m is represented by HS, the thickness in the radial direction thereof by WS, the height of the vanes 10 in the direction of the tube axis m by HV, the thickness thereof by TV, and the distance between the free ends of adjoining vanes 10 by GV, it is desirable that these dimensions be within the ranges expressed by the following formulae (2) to (4).

Incidentally, no distinction is made between the large-diameter strap ring 11A and the small-diameter strap ring 11B because HS is equal to WS. No distinction is made between the vanes 10A and 10B because the vanes 10A and 10B are equal in size.

$$0.1 \leq HS/HV \leq 0.19 \quad (2)$$

$$0.06 \leq WS/WV \leq 0.09 \quad (3)$$

$$GV/(GV+TV) \leq 0.375 \quad (4)$$

That is, in the case of the magnetron 1, it is preferred that HV be in a range of 7.8 mm to 8.2 mm; that HS be in a range of 0.8 mm to 1.5 mm; that WS be in a range of 0.9 mm to 1.3 mm; that WV be in a range of 13.7 mm to 14.1 mm; that TV being a range of 1.70 mm to 1.85 mm; and that GV be in a range of 0.929 mm to 0.929 mm+10%.

As described above, in the case of the present embodiment, the inner diameter of the output side pole piece 17 is 9.2 mm; the inner diameter of the input side pole piece 18 is 9.4 mm; and the diameter of the vane inscribed circle Cr is 8.7 mmϕ.

Figure 7:
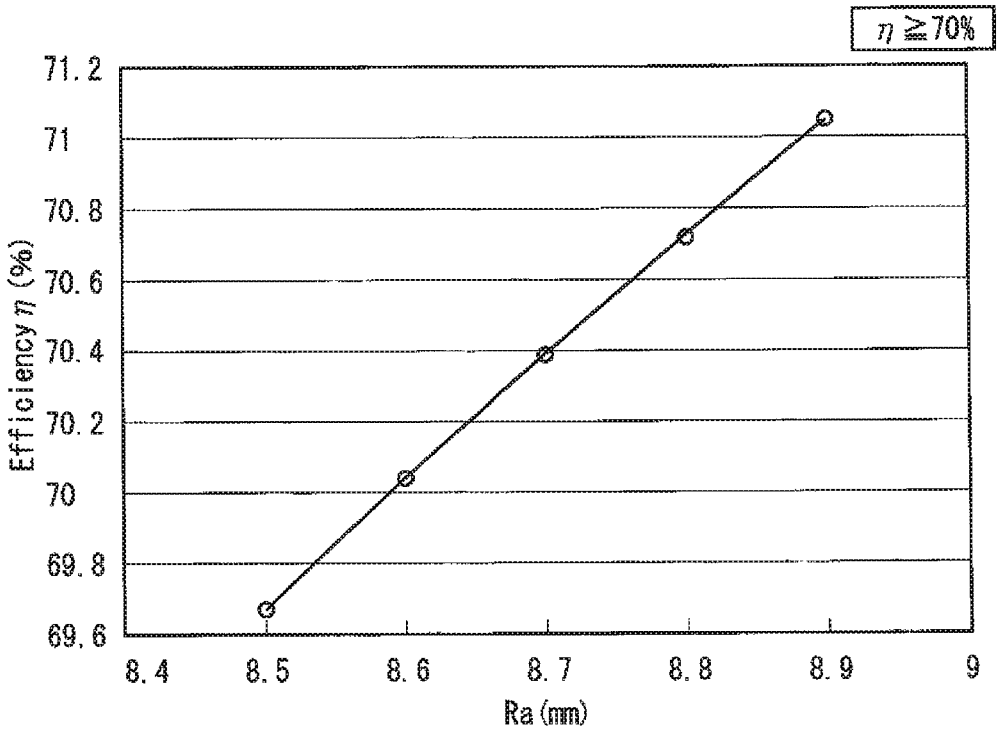
FIG. 7 is a diagram and table showing relation between dimensions of a vane inscribed circle and efficiency illustrating a magnetron according to one embodiment of the present invention.
Figure 8:
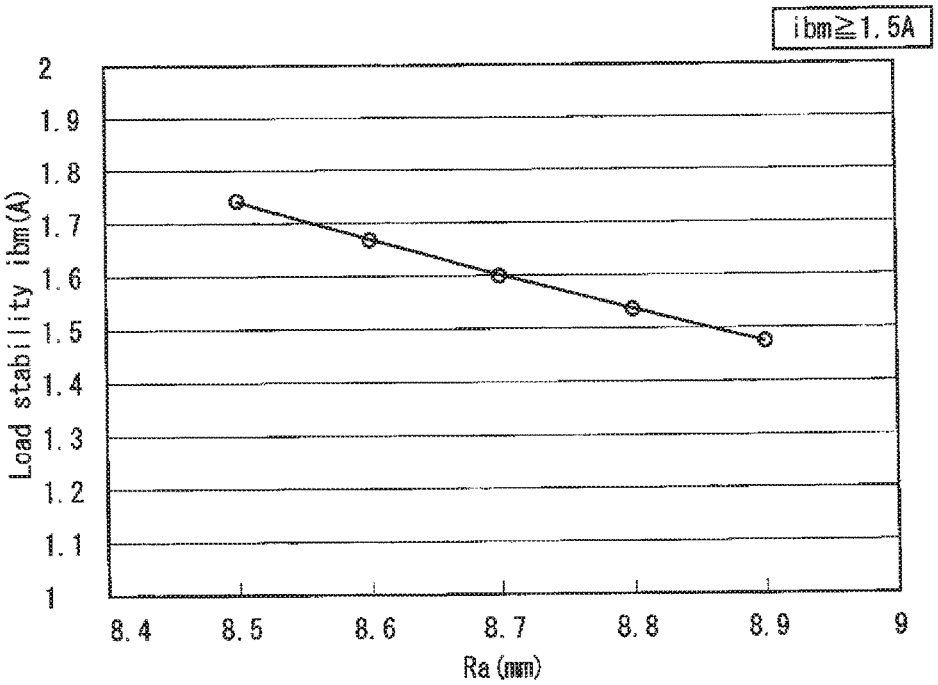
FIG. 8 is a diagram and table showing relation between dimensions of a vane inscribed circle and load stability illustrating a magnetron according to one embodiment of the present invention.

As shown in FIGS. 7 and 8, a larger diameter (represented as Ra) of the vane inscribed circle Cr leads to an increase in efficiency but a reduction in load stability. Accordingly, in the case of the present embodiment, the diameter Ra of the vane inscribed circle Cr is set at 8.7 mmϕ. Therefore, it is possible to achieve a load stability of 1.5 A or more, which does not cause any practical problem, while obtaining 70 percent or more of efficiency.

Figure 9:
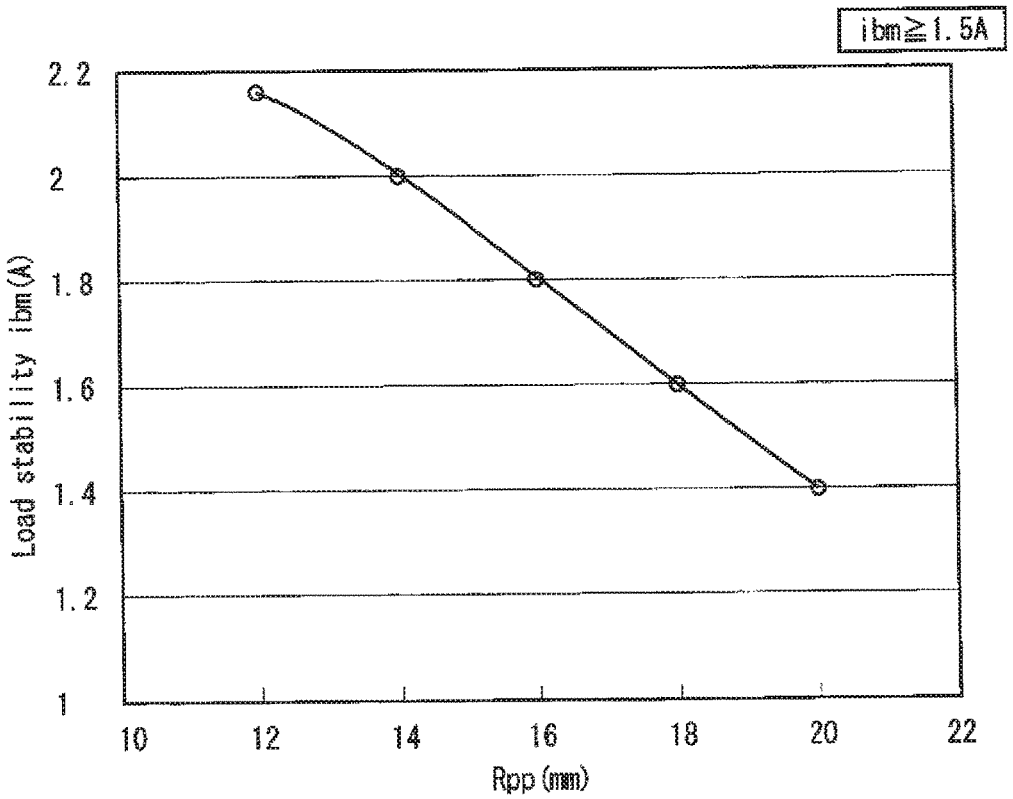
FIG. 9 is a diagram and table showing relation between dimensions of a pole piece and load stability illustrating a magnetron according to one embodiment of the present invention.

A larger inner diameter (represented as Rpp) of the input side pole piece 17 is better in terms of the reverse impact by electrons. However, if the inner diameter is significantly different from the size of the electron interaction space, a sufficient amount of magnetic flux is unlikely to enter the electron interaction space. As a result, as shown in FIG. 9, the load stability would decrease. Therefore, the inner diameter Rpp of the input side pole piece 17 needs to be appropriately designed relative to the diameter Ra of the vane inscribed circle Cr.

Accordingly, the inner diameter Rpp of the input side pole piece 17 is preferably set so that the ratio of the inner diameter Rpp to the diameter Ra of the vane inscribed circle Cr comes within the range of 0.95 to 1.13.

Figure 10:
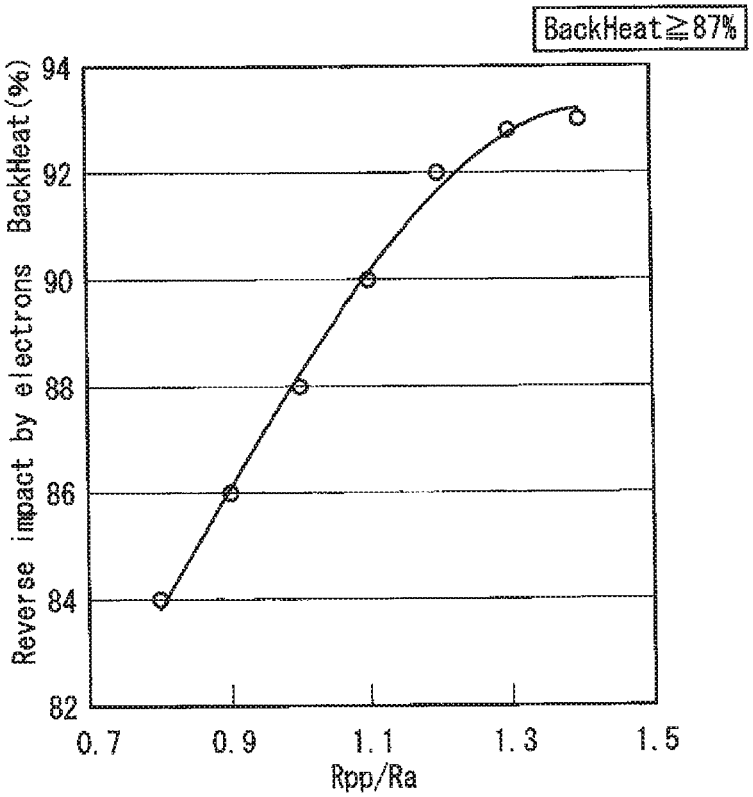
FIG. 10 is a diagram and table showing relation between the reverse impact by electrons and a ratio in dimensions of a pole piece to a vane inscribed circle illustrating a magnetron according to one embodiment of the present invention.
Figure 11:
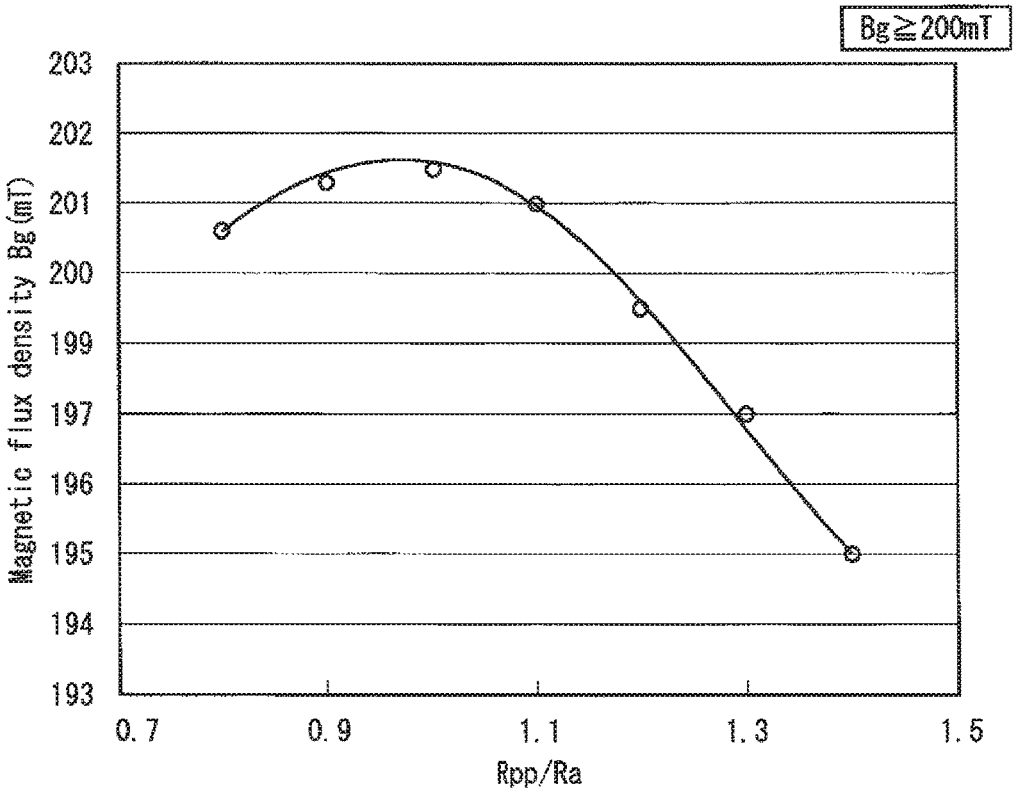
FIG. 11 is a diagram and table showing relation between magnetic flux density and a ratio in dimensions of a pole piece to a vane inscribed circle illustrating a magnetron according to one embodiment of the present invention.

The findings are based on the results of verification which focused on the reverse impact by electrons and the magnetic flux density inside the electron interaction space when the diameter Ra of the vane inscribed circle Cr remained unchanged and when the inner diameter Rpp of the input side pole piece 17 was changed. FIGS. 10 and 11 show data of the results of verification.

It is clear from the results of verification that, when the ratio of the inner diameter Rpp of the input side pole piece 17 to the diameter Ra of the vane inscribed circle Cr is within the range of 0.95 to 1.13, the reverse impact by electrons is 87% or more and the magnetic flux density inside the electron interaction space is 200 mT or more. In this manner, practically sufficient characteristics are obtained.

Further, it is similarly preferred that the inner diameter of the output side pole piece 17 be set so that the ratio of the inner diameter of the output side pole piece 17 to the diameter Ra of the vane inscribed circle Cr is included in the range of 0.95 to 1.13.

Figure 14:
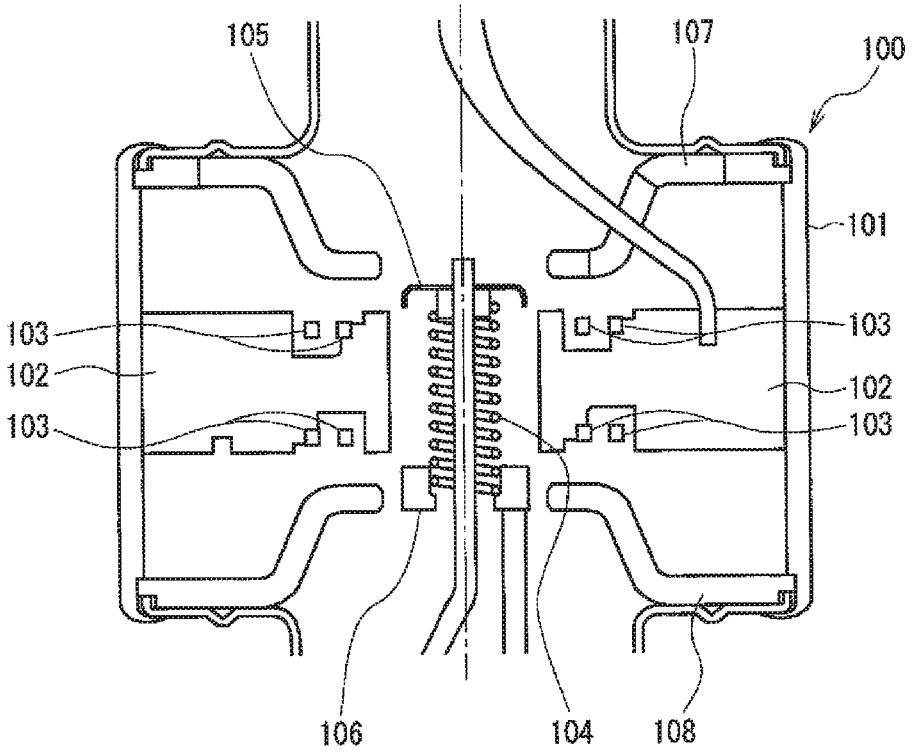
FIG. 14 is a longitudinal cross-sectional view of major portions of a conventional magnetron.

Besides, as shown in FIG. 14, in the case of the conventional magnetron, one type of vanes 102 having the same shape is disposed in such a way as to be alternately turned upside-down. In the magnetron 1 of the present embodiment, as shown in FIGS. 2 and 3, two types of vanes 10A and 10B having notches 30 and 31 that are different in shape are alternately disposed.

In this manner, in the case of the magnetron 1 of the present embodiment, the number of types of vanes is increased to two. However, press dies used to produce the vanes can punch out multiple rows of components at once on a metal plate. Therefore, there is no extra cost for the dies, even when compared with cases where only one type of vanes is used as in the conventional case.

At a time when the vanes are formed by press working, a shear droop would be formed on the free-end side of one surface in the thickness direction.

Figure 12:
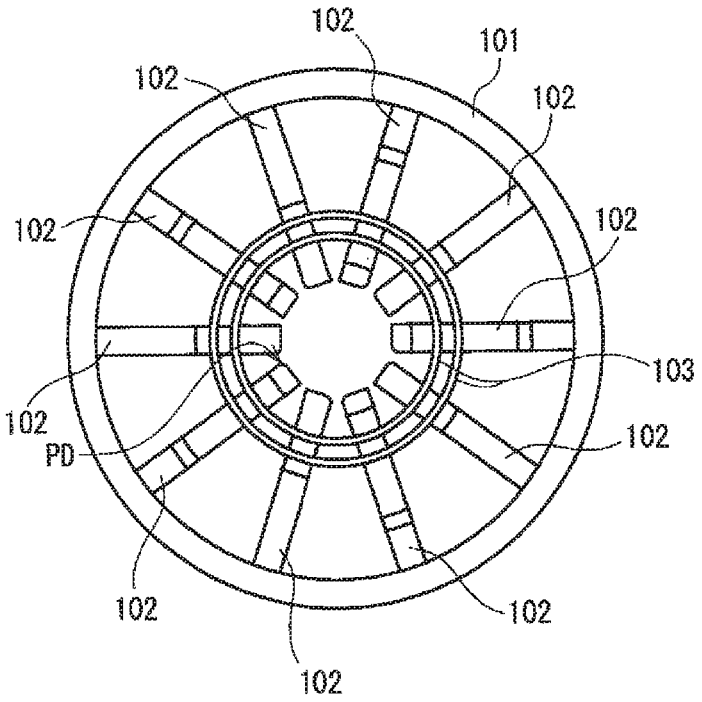
FIG. 12 is a lateral cross-sectional view of major portions of a conventional magnetron, showing the direction of shear droop.

In the case of the conventional magnetron, one type of vanes 102 is disposed in such away as to be alternately turned upside-down. Therefore, as shown in FIG. 12, the vanes 102 are alternately disposed so that the surfaces where the shear droop PD is formed face each other. Accordingly, in the case of the conventional magnetron, one surface in the thickness direction of each vane 102 cannot be turned in the same direction around the axis, i.e. the clockwise direction in the diagram, and the shear droop PD cannot be aligned in the same direction.

In the case of the magnetron 1 of the present embodiment, two types of vanes 10A and 10B are alternately disposed. Therefore as shown in FIG. 3, the two types of vanes 10A and 10B can be alternately disposed in such a way that a surface where the shear droop PD is formed faces another surface where no shear droop PD is formed.

Still, the press stamping directions of the two types of vanes 10A and 10B are the same. Accordingly, the shear droop PD is formed on the free-end side of one surface in the thickness direction of each vane.

Therefore, in the magnetron 1, one surface in the thickness direction of each vane 10A, 10B can be turned in the same direction around the axis, i.e. the clockwise direction in the diagram, and the shear droop PD can be aligned in the same direction.

Thus, in the case of the magnetron 1, compared with the conventional magnetron, the variation in shape of each cavity resonator that is divided into 10 by each vane 10A, 10B, can be reduced, resulting in a decrease in the variation of the frequency. Consequently, it is possible to make smaller the spread of a fundamental-wave spectrum.

Figure 13:
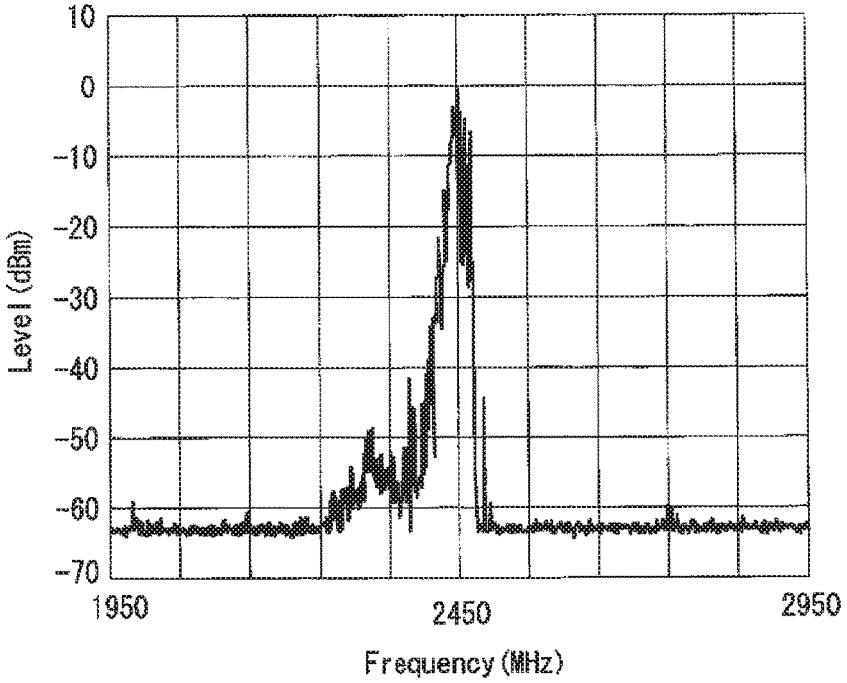
FIG. 13 is a diagram showing fundamental-wave spectrums of a magnetron of the present invention and a conventional magnetron.
Figure 13:
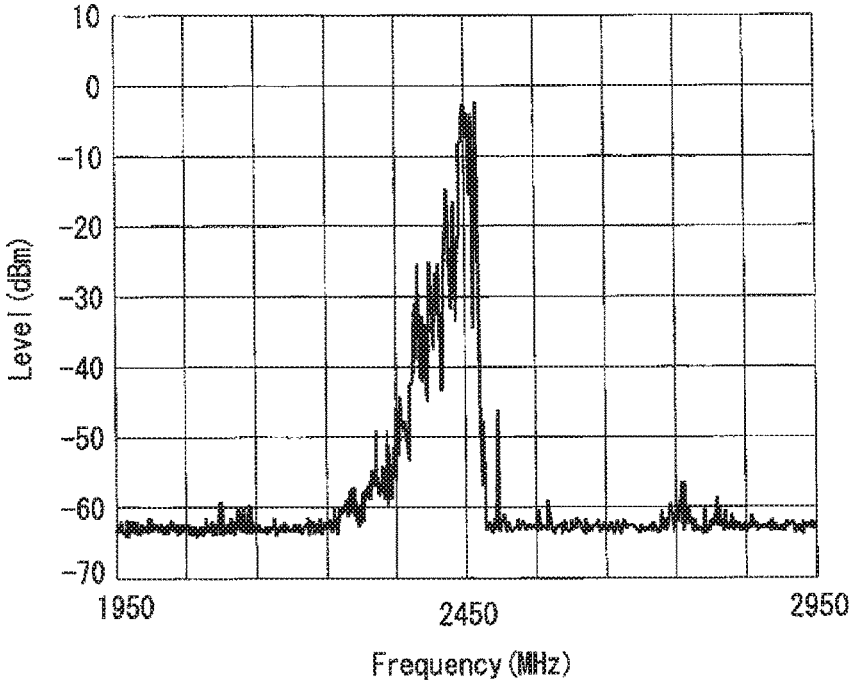

FIGS. 13(A) and 13(B) show the fundamental-wave spectrum of the magnetron 1 of the present embodiment (FIG. 13(A)), and the fundamental-wave spectrum of the conventional magnetron (FIG. 13(B)). As can be seen in FIG. 13, the fundamental-wave spectrum of the magnetron 1 of the present embodiment favorably compares with the fundamental-wave spectrum of the conventional magnetron.

As described above, in the case of the magnetron 1 of the present embodiment, the two large and small strap rings 11 (11A and 11B) are only disposed on the lower end sides, i.e. input sides, in the direction of the tube axis m of the plurality of vanes 10 (10A and 10B). The diameter Rip of the protruding flat surface 41 of the input side pole piece 18 is made larger than the diameter Rop of the protruding flat surface 40 of the output side pole piece 17.

In that manner, it is possible to provide a practical magnetron without greatly reducing productivity or characteristics from a conventional one, while cutting costs by decreasing the number of parts with the use of two strap rings on one side.

Furthermore, according to the present embodiment, the diameter Rop of the protruding flat surface 40 of the output side pole piece 17, the diameter Rip of the protruding flat surface 41 of the input side pole piece 18, the outer diameter Rlo of the large-diameter strap ring 11A, and the inner diameter Rsi of the small-diameter strap ring 11B are set in such a way as to satisfy the above formula (1).

Furthermore, according to the present embodiment, the height HV in the direction of the tube axis m of the vanes 10 is set in such a way as to be within the range of 7.8 mm to 8.2 mm. Moreover, the height HS in the direction of the tube axis m of the strap rings 11, the radial-direction thickness WS, the height HV in the direction of the tube axis m of the vanes 10, the thickness TV, and the distance GV between the free ends of adjacent vanes 10 are set in such a way as to be in the ranges expressed by the above formulae (2) to (4).

Furthermore, according to the present embodiment, the inner diameter Rpp of the input side pole piece 17 is set in such a way that the ratio of the inner diameter Rpp to the diameter Ra of the vane inscribed circle Cr is between 0.95 and 1.13.

Furthermore, according to the present embodiment, two types of vanes 10A and 10B are alternately disposed. In this manner, the shear droop PD that is formed on each vane 10A, 10B is aligned in the same direction.

As a result, it is possible to provide a magnetron with well-balanced excellent characteristics in terms of efficiency, higher harmonic waves, which would become unnecessary radiation, load stability, the reverse impact by electrons, magnetic flux density in the electron interaction space, variation in the frequency, and the like.

Incidentally, in the case of the above-described embodiment, the dimensions of each portion of the magnetron 1 are expressed in mm (millimeter). This is one example when the magnetron is used in microwave ovens and the like. For example, in the case of an even larger magnetron, the dimensions of each portion could be much larger. However, even in such a case, the relative dimensions of each portion should remain the same as in the magnetron 1.

EXPLANATION OF REFERENCE SYMBOLS

1: Magnetron
2, 100: Anode structure
3, 104: Cathode
6, 101: Anode cylinder
10, 102: Vane
11, 103: Strap ring
17, 18, 107, 108: Pole piece
21: Antenna
40, 41: Protruding flat surface
PD: Shear droop

The invention claimed is:

1. A magnetron comprising:

an anode cylinder extending cylindrically along a tube axis;

a plurality of vanes extending from an inner surface of the anode cylinder toward the tube axis with free ends forming a vane inscribed circle;

a large strap ring and a small strap ring with respective different diameters and short-circuiting alternating ones of the plurality of vanes;

a cathode disposed along the tube axis in the vane inscribed circle formed by the free ends of the plurality of vanes;

pole pieces disposed at both ends of the anode cylinder in a tube axis direction to lead magnetic flux into an interaction space between the free ends of the plurality of vanes and the cathode; and an antenna extending from at least one of the vanes, characterized in that:

the strap rings are only disposed on a cathode input side end, in the tube axis direction, of the vanes, the shape of the pole piece disposed at one end of the anode cylinder in the tube axis direction and the shape of the pole piece disposed at the other end are asymmetrical, and the pole pieces disposed at both ends of the anode cylinder in the tube axis direction include protruding flat surfaces, and a diameter of the protruding flat surface of the pole piece disposed at one end of input side is larger than a diameter of the protruding flat surface of the pole piece disposed at the other end of output side, wherein a diameter (Rop) of the protruding flat surface of the pole piece disposed at the output side, a diameter (Rip) of the protruding flat surface of the pole piece disposed at the input side, an inner diameter (Rsi) of the small strap ring, and an outer diameter (Rlo) of the large strap ring satisfy the following conditional expression (1):

$$Rop<(Rsi+Rlo)/2\leq Rip. \quad (1)$$

2. The magnetron according to claim 1, wherein the antenna is pulled out from a vane that is short-circuited by the large strap ring.

3. The magnetron according to claim 1, wherein a notch is formed in a cathode input side end portion of each of the vanes; and the large and small strap rings are each disposed inside the notch of the cathode input side end portion of the vanes.

4. The magnetron according to claim 3, wherein a height (HS) of the large and small strap rings in the tube axis direction, a width (WS) of the large and small strap rings in the radial direction, a height (HV) of the vanes in the tube axis direction, a width (WV) of the vanes in the radial-direction, a thickness (TV) of the vanes, and a distance (GV) between free ends of adjoining vanes satisfy the following conditional expressions (2) to (5):

$$7.8\leq HV\leq 8.2, \text{ in millimeters} \quad (2)$$

$$0.1\leq HS/HV\leq 0.19 \quad (3)$$

$$0.06\leq WS/WV\leq 0.09 \quad (4)$$

$$GV/(GV+TV)\leq 0.375. \quad (5)$$

5. The magnetron according to claim 1, wherein there are two types of the vanes;

the vanes have press stamping directions that are the same; and the vanes are disposed in such a way that a shear droop that is formed during press working is aligned in the same direction.

6. The magnetron according to claim 1, wherein an inner diameter (Rpp) of each of the pole pieces disposed at the output and input sides, and a diameter (Ra) of the vane inscribed circle, satisfy the following conditional expression (6):

$$0.95\leq Rpp/Ra. \quad (6)$$

7. A magnetron comprising:

an anode cylinder extending cylindrically along a tube axis;

a plurality of vanes extending from an inner surface of the anode cylinder toward the tube axis with free ends forming a vane inscribed circle;

a large strap ring and a small strap ring with respective different diameters and short-circuiting alternating ones of the plurality of vanes;

a cathode disposed along the tube axis in the vane inscribed circle formed by the free ends of the plurality of vanes;

pole pieces disposed at both ends of the anode cylinder in a tube axis direction to lead magnetic flux into an interaction space between the free ends of the plurality of vanes and the cathode; and an antenna extending from at least one of the vanes, characterized in that:

the strap rings are only disposed on a cathode input side end, in the tube axis direction, of the vanes, the shape of the pole piece disposed at one end of the anode cylinder in the tube axis direction and the shape of the pole piece disposed at the other end are asymmetrical, and the pole pieces disposed at both ends of the anode cylinder in the tube axis direction include protruding flat surfaces, and a diameter of the protruding flat surface of the pole piece disposed at one end of input side is larger than a diameter of the protruding flat surface of the pole piece disposed at the other end of output side, wherein a height (HS) of the large and small strap rings in the tube axis direction, a width (WS) of the large and small strap rings in the radial direction, a height (HV) of the vanes in the tube axis direction, a width (WV) of the vanes in the radial-direction, a thickness (TV) of the vanes, and a distance (GV) between free ends of adjoining vanes satisfy the following conditional expressions (1) to (4):

$$7.8 \leq HV \leq 8.2, \text{ in millimeters}, \quad (1)$$

$$0.1 \leq HS/HV \leq 0.19; \quad (2)$$

$$0.06 \leq WS/WV \leq 0.09; \quad (3)$$

$$GV/(GV+TV) \leq 0.375. \quad (4)$$

8. The magnetron according to claim 7, wherein a diameter (Rop) of the protruding flat surface of the pole piece disposed at the output side, a diameter (Rip) of the protruding flat surface of the pole piece disposed at the input side, an inner diameter (Rsi) of the small strap ring, and an outer diameter (Rlo) of the large strap ring satisfy the following conditional expression (5):

$$Rop < (Rsi+Rlo)/2 < Rip. \quad (5)$$

9. The magnetron according to claim 7, wherein the antenna is pulled out from a vane that is short-circuited by the large strap ring.

10. The magnetron according to claim 7, wherein a notch is formed in a cathode input side end portion of each of the vanes; and the large and small strap rings are each disposed inside the notch of the cathode input side end portion of the vanes.

11. The magnetron according to claim 7, wherein there are two types of the vanes;

the vanes have press stamping directions that are the same; and the vanes are disposed in such a way that a shear droop that is formed during press working is aligned in the same direction.

12. The magnetron according to claim 7, wherein an inner diameter (Rpp) of each of the pole pieces disposed at the output and input sides, and a diameter (Ra) of the vane inscribed circle, satisfy the following conditional expression (6):

$$0.95 \leq Rpp/Ra \leq 1.13. \quad (6)$$

* * * * *